United States Patent [19]

Blewitt

[11] 4,204,183

[45] May 20, 1980

[54] TAPERED STRAP ELEMENT FOR AN ELECTRICAL FUSE

[75] Inventor: Donald D. Blewitt, Penn Hills Township, Allegheny County, Pa.

[73] Assignee: Westinghouse Electric Corp., Pittsburgh, Pa.

[21] Appl. No.: 904,349

[22] Filed: May 9, 1978

Related U.S. Application Data

[63] Continuation of Ser. No. 667,792, Mar. 17, 1976, abandoned.

[51] Int. Cl.[2] ..... H01H 85/08

[52] U.S. Cl. ..... 337/295; 337/159

[58] Field of Search ..... 337/158, 159, 187, 276, 337/290, 295, 163; 29/623

[56] References Cited

U.S. PATENT DOCUMENTS

| | | | |
|---|---|---|---|
| 2,157,906 | 5/1939 | Lohausen | 337/295 |
| 2,157,907 | 5/1939 | Lohausen | 337/159 |
| 3,138,682 | 6/1964 | Dannenberg et al. | 337/295 |
| 3,909,766 | 9/1975 | Cameron et al. | 337/295 |

FOREIGN PATENT DOCUMENTS

| | | | |
|---|---|---|---|
| 28562 | 12/1964 | German Democratic Rep. | 337/295 |

*Primary Examiner*—Harold Broome
*Attorney, Agent, or Firm*—M. J. Moran

[57] ABSTRACT

An electrical fuse is taught having a ribbon-like fuse element therein. The fuse element has a generally uniform width along its length, but the depth of the fuse element is tapered in some regions. Holes or openings of various shapes are disposed along the length of the fuse through the depth thereof. The holes may be circular, triangular, or rectangular in shape and may be through a central portion of the fuse element or may comprise notches at the edges of the fuse element or both. The depth of the fuse element may increase with longitudinal distance from a relatively thin central portion of the fuse element to relatively thick end portion thereof, or vice versa. During low current clearing, the relatively thin portion will melt first and then burns back along the tapered portions until the fault current is extinguished. During high current interruption the fuse element will melt first at the notches located on the thin portion of the element and then progressively at the notches along the tapered portion of the element. Multiple arclets are thus formed in series which merge towards each other with time. Each arclet provides a component voltage for a composite arc voltage which limits current.

14 Claims, 24 Drawing Figures

TAPERED STRAP ELEMENT FOR AN ELECTRICAL FUSE

This is a continuation of application Ser. No. 667,792 filed Mar. 17, 1976 now abandoned.

BACKGROUND OF THE INVENTION

1. Field of the Invention

The subject matter of this invention relates generally to tapered fuse elements and relates in particular to tapered fuse elements having a length which is significantly larger than the width of depth thereof.

2. Description of the Prior Art

The use of current limiting fuses having areas of reduced cross sections is generally known. One popular way to provide areas of reduced cross sections is to notch a fuse link at the sides thereof. Examples of this may be found in the following U.S. Pat. Nos. 2,181,825, issued Nov. 28, 1939 to M. B. Wood, 2,816,989, issued Dec. 17, 1957 to E. W. Sugden, 3,386,062, issued May 28, 1968 to F. J. Kozacka, 3,394,333, issued July 23, 1968 to P. C. Jacobs, Jr., and 3,835,431, issued Sept. 10, 1974 to P. Rosen et al. Another common way to provide areas of reduced cross section is to provide central openings in the fuse ribbon. The openings are typically circular, rectangular, or triangular in shape. Examples of fuses with central openings follow: U.S. Pat. Nos. 3,319,029, issued May 9, 1967 to P. J. Jacobs, Jr.; U.S. Pat. No. 3,425,018, issued Jan. 28, 1969 to F. J. Kozacka, U.S. Pat. No. 3,471,818, issued Oct. 7, 1969 to R. E. Koch, and U.S. Pat. No. 3,523,265, issued Aug. 4, 1970 to J. Feenan et al. In addition to the preceding, fuses of reduced cross section are taught which have both central opening and notched edges. Examples of this type of fuse follow: U.S. Pat. No. 2,055,866, issued Sept. 29, 1936 to O. H. E. Jung et al and U.S. Pat. No. 3,465,275, issued Sept. 2, 1969 to K. W. Swain. Generally, all of the above-mentioned fuses have a uniform length and depth, but have reduced width at the areas of reduced cross section. Still another way to produce areas of reduced cross section is to provide a fuse with uniform length and width, but with scored or cut away portions of the fuse depth. An example of this kind of fuse element is as follows: U.S. Pat. No. 3,524,157, issued Aug. 11, 1970 To E. Salzer. Still another kind of fuse with areas of reduced cross section employs a notched side and a scored width. Examples of this type of fuse are as follows: U.S. Pat. No. 3,288.968, issued Nov. 29, 1966 to J. Feenan et al and U.S. Pat. No. 3,413,586, issued Nov. 26, 1968 to E. Salzer. Still another kind of fuse element with an area of reduced cross section comprises a fuse wire rather than a fuse ribbon, where the fuse wire has discrete discontinuities or a continuous tapers. Examples of this kind of fuse are shown in the prior art of FIGS. 5 and 7 of U.S. Pat. No. 3,848,445, issued Nov. 19, 1974 to F. L. Cameron and assigned to the assignee of the present invention. It is submitted that closest prior art to the present invention seems to lie in the kinds of fuse elements which have uniform depth, but tapered widths. Examples of these kinds of fuses are found in U.S. Pat. No. 3,743,994, issued July 3, 1973 to F. J. Kozacka (FIG. 2), British Pat. No. 445,902, dated Jan. 8, 1935 (FIG. 1) and British Pat. No. 514,916, dated May 18, 1938. In the latter patents, the length and depth of the fuse element are maintained generally constant, but the width thereof is varied. It would be convenient if a fuse element could be found which had all of the advantages of reduced cross section and a tapered longitudinal dimension, but which could nevertheless be drilled centrally or notched to provide other areas of reduced cross section for further improved current limiting action.

SUMMARY OF THE INVENTION

In accordance with the invention, a current limiting fuse is taught having end ferrules and a hollow cylindrical tube upon which the ferrules are disposed. A fuse element is disposed within the tube in electrical communication with both ferrules. The fuse element has outer surfaces which are substantially flat. The length of the fuse element is significantly larger than the width thereof. The depth of the fuse element is substantially nonuniform; and the width of the fuse element is significantly larger at its smallest point than the depth is at its largest point. In one embodiment of the invention, the fuse element is thicker in the central portion of its length and tapers towards the end. In another embodiment of the invention, the fuse is thickest at the ends and tapers towards a relatively thin middle. In most embodiments of the invention, holes are punched or otherwise disposed in the fuse element or notches are provided along the edges of the fuse element or both notches and central holes are provided for enhancing the current limiting action of the fuse by providing other areas of reduced cross section.

BRIEF DESCRIPTION OF THE DRAWINGS

For a better understanding of the invention, reference may be had to the preferred embodiments shown in the accompanying drawings, in which.

DESCRIPTION OF THE PREFERRED EMBODIMENTS

Figure 3:
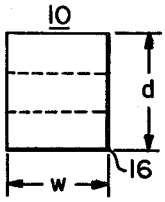
FIG. 3 shows an end view of the fuse of FIG. 1.
Figure 1:
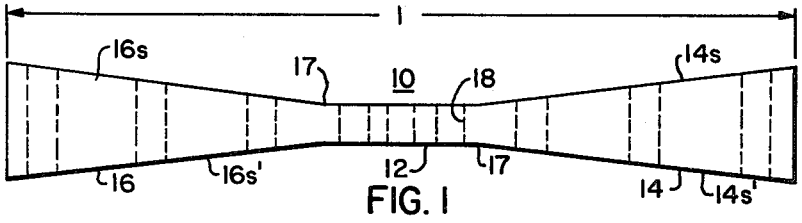
FIG. 1 shows a side elevation of a fuse element which is tapered towards the middle from both ends.
Figure 2:
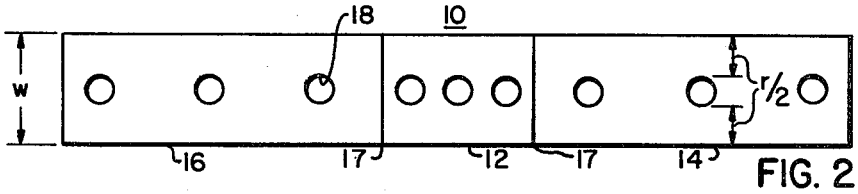
FIG. 2 shows a top view of the fuse of FIG. 1.

Referring now to the drawings, and FIGS. 1, 2 and 3 in particular, a fuse element 10 having a generally constant width w and variable depth d is shown. For purposes of clarity, the width w and depth d of the fuse element 10 relative to its length l are exaggerated. It is to be understood that the fuse element 10 as well as fuse elements 10*a*, 10*b*, 30, 30*a*, 30*b*, 50*a*, 60*a*, 60*b* and 60*c*, which follow, are shown in their respective exaggerated forms merely for the purpose of clarity of illustration. Generally speaking, all of the aforementioned fuse elements comprise generally ribbon-shaped fuse elements—that is, the length l of the fuse element is significantly larger than the width w thereof, which in turn, is significantly larger than the depth d thereof. Fuse element 10 has a relatively narrow depth in the region 12, which may be central of the length l of the fuse element 10. It is to be understood that the relative placement of the region 12 may be to the right or left of the relative position shown in FIG. 1, within limits. There is to the right of the relatively narrow region 12 a region of increasing depth 14. Likewise, to the left of region 12 there is another region of increasing depth 16. It is to be understood that the relative slopes 14*s* 14*s*′ of portion 14 and slopes 16*s* and 16*s*′ of portion 16 need not be equal, though they are shown to be equal in FIG. 1. Generally, the fuse element of FIG. 1 is characterized as having a series of flat surfaces which intersect at convenient places to form a fuse element. One of the main characteristics of the fuse element 10 and the other fuse elements which follow is that the width w thereof is significantly larger than the depth d thereof and significantly smaller than the length l thereof. The characteristic allows for the convenient placement of central holes or openings 18 or side notches in at least a portion of the depth d of the fuse element 10 by drilling or punching through the surface described by l-w. The presence of the holes or openings 18, which generally extend through the entire depth d of the fuse element if that is desired, provides areas of reduced cross section. It is at these areas of reduced cross section that the fuse will most likely burn or first melt when high current flows therethrough. This, of course, provides concurrent multiple arclets, the accumulated series effect of which is additive and which therefore act to effectively limit or reduce the current flowing through the fuse. It will be noted that the surface 12 is relatively flat and intersects the slopes 14*s*, 14*s*′ 16*s*, and 16*s*′, for example, at the interfacing lines 17. During a low current fusing operation, it has been found that the region 12, because of its significantly reduced cross section, i.e., the smallest depth d along the entire length l of the fuse, is the first to melt. It is at this region therefore that a single arc is established. The arc burns away material in the regions 14 and 16 during the remaining portion of the fusing cycle. As was mentioned previously, during a high current fusing operation, it is expected that all of the areas of reduced cross section associated with the numerous circular holes 18 fuse or burn away in the thin portion of the element and then progressively along the tapered portion towards the thicker part thereof thus providing multiple sequential arclets until the entire body of fuse material is consumed by the arc of the fusing operation.

Figure 6:
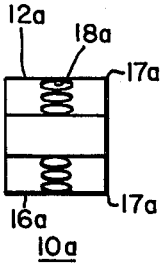
FIG. 6 shows an end view of the fuse element of FIG. 4.
Figure 4:
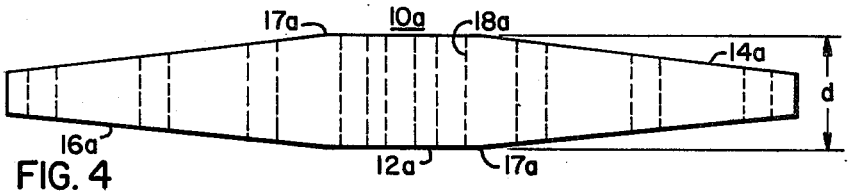
FIG. 4 shows a fuse element tapered towards the ends from the middle.
Figure 5:
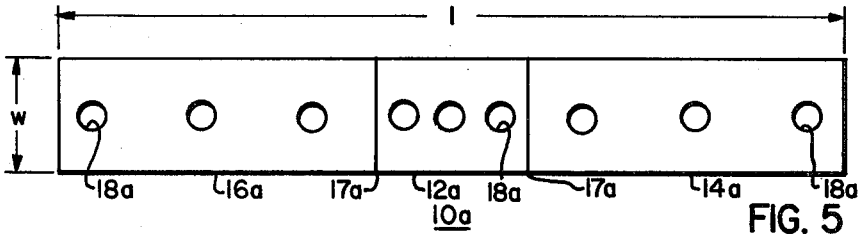
FIG. 5 shows a top view of the fuse element of FIG. 4.

Referring now to FIGS. 4, 5 and 6, a fuse element 10*a* is shown. Fuse element 10*a* acts, in many ways, similarly to fuse element 10 during a fusing operation. In this case, however, it will be noted that the central region 12*a* has the largest relative depth and the ends of the tapered regions 14*a* and 16*a* have the smallest relative depth. The relatively flat region 12*a* interface with the sloped or tapered regions 14*a* and 16*a* at the interfacing lines 17*a*. Circular holes 18*a* are disposed conveniently through the entire depth of the fuse element 10*a*.

Figure 9:
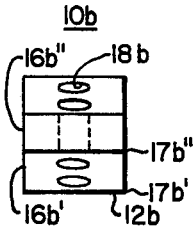
FIG. 9 shows an end view of the fuse element of FIG. 7.
Figure 7:
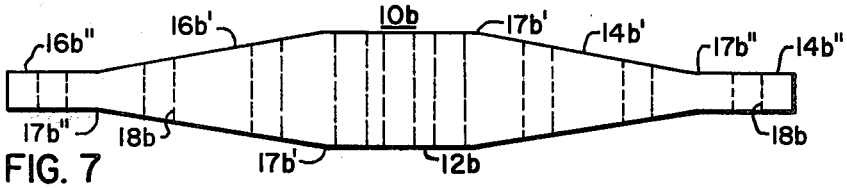
FIG. 7 shows a side elevation of a fuse similar to that of FIG. 4, but with a relatively flat plateau at either end thereof.
Figure 8:
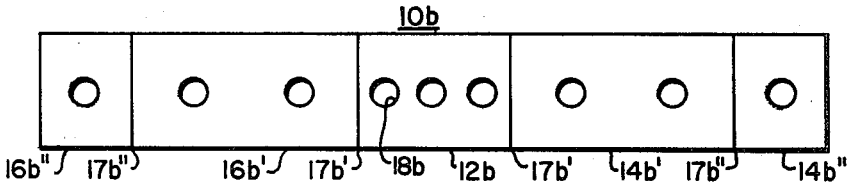
FIG. 8 shows a top view of the fuse element of FIG. 7.

Referring now to FIGS. 7, 8 and 9, still another embodiment of the invention is shown in which a fuse element 10*b* is depicted. Fuse element 10*b* is similar to fuse element 10*a*, except that the tapered regions 14*b*′ and 16*b*′ do not terminate at the end of the fuse element, but rather terminate short of the end of the fuse element, thus forming small plateau regions 14*b*″ and 16*b*″ at the ends respectively of the tapered regions 14*b*′ and 16*b*′. As was the case with respect to fuse elements 10 and 10*a*, described previously, there is a relatively flat region 12*b* generally centrally located of the tapered regions 14*b*′ and 16*b*′. The relatively flat region 12*b* is separated from the sloped regions 14*b*′ and 16*b*′ by the interface line 17*b*′. In a similar fashion, the tapered regions 14*b*″ and 16*b*″ are separated from the smaller plateau regions 14*b*′ and 16*b*′ by the interface lines 17*b*″. As was the case with respect to the fuse elements 10 and 10*a*, central holes 10*b* are disposed conveniently along the length of the fuse element 10*b*. The plateau regions 14*b*′ and 16*b*′ are flattened to such an extent that they may be disposed or mounted in a fuse assembly.

Figure 10:
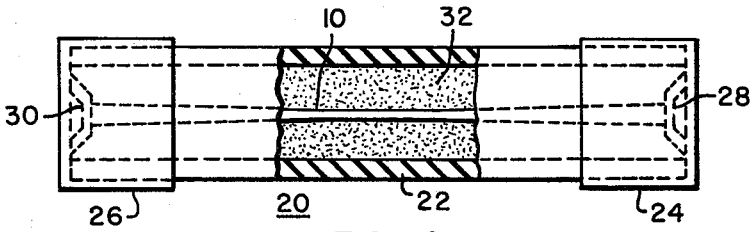
FIG. 10 shows a fuse which is partially cut away and which shows a tapered fuse element internal thereto.

Referring now to FIG. 10, a fuse 20 is shown. Fuse 20 comprises a central, hollow, cylindrical, electrically insulating barrel or fuse enclosure 22. On the right end of barrel 22, as viewed in FIG. 10, is disposed a ferrule or terminal 24. Likewise, on the left end of barrel 22, as shown in FIG. 10, is disposed another ferrule or terminal 26. Associated with the ferrule 24 is a fuse element support 28 and associated with the ferrule 26 is a support 30. The supports 28 and 30 conveniently secure a fuse element 10 within the barrel 22 of the fuse 20. There may be disposed within the remaining internal portions of the fuse 20 pulverulent arc quenching material 32 such as quartz sand. The fusing operation of the fuse element 10 has been described previously with respect to FIGS. 1, 2 and 3. It should be understood that fuse elements 10*a*, 10*b*, 30, 30*a*, 30*b*, 50*a*, 60*a*, 60*b* and 60*c* may also be utilized in place of fuse element 10 for the fuse 20 of FIG. 10. It should also be understood that any fuse element which embodies the novel concepts of this invention as described herein may be utilized in place of the fuse element 10 of FIG. 10.

Figure 13:
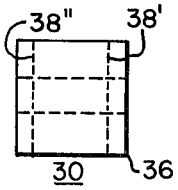
FIG. 13 shows an end view of the fuse of FIG. 11.
Figure 11:
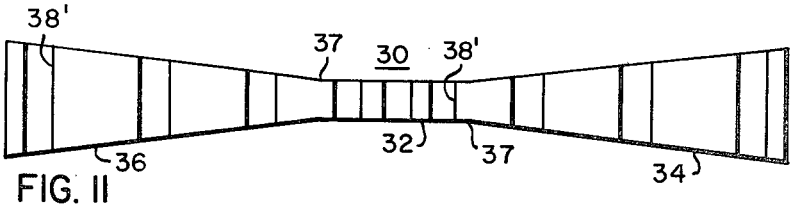
FIG. 11 shows a fuse element similar to that shown in FIG. 1, but with semicircular notches at the edges thereof.
Figure 12:
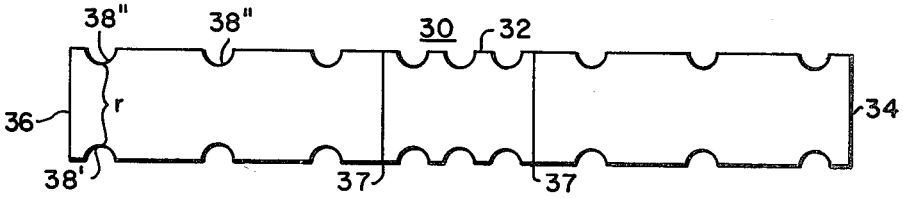
FIG. 12 shows a top view of the fuse of FIG. 11.

Referring now to FIGS. 11, 12 and 13, still another embodiment of the invention is shown. In this embodiment of the invention, a fuse element 30 is depicted. Fuse element 30 is essentially the same as fuse element 10 of FIGS. 1, 2 and 3, except that the central holes or openings 18 of fuse element 10 have been replaced by semicircular side notched regions 38' and 38" in fuse element 30. Fuse element 30, like the fuse elements previously described and those which will be described hereafter, is essentially of uniform width throughout, ignoring the slight deviations in width due to the notches 38' and 38". It is the depth of the fuse element which has been altered to improve the current limiting capabilities of the fuse. Fuse element 30 includes a central region 32 of relatively small depth and regions 34 and 36 of continuously increasing depth on either end thereof as viewed in FIG. 11. The relatively narrow region 32 is separated from the tapered regions 34 and 36 by interfacing lines 37. The semicircular grooves 38' on one side of the fuse element and 38" on the other side thereof may extend through the entire depth of the fuse element 30. The presence of complementary pairs of notches 38' and 38" may form an area or region of reduced cross section having a width r. Of course it is to be understood that one of the notches may be missing, thus increasing the width of the region, but nevertheless producing an area of reduced cross section along the width of the fuse 30.

Figure 16:
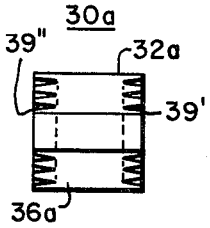
FIG. 16 shows an end view of the fuse element of FIG. 14.
Figure 14:
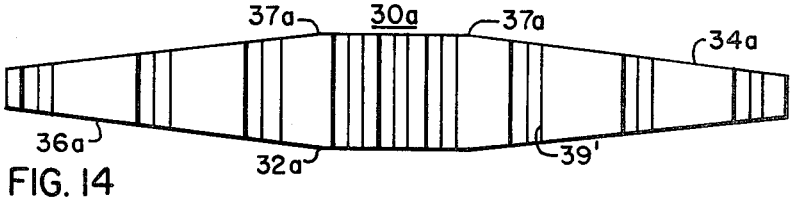
FIG. 14 shows a fuse element similar to that of FIG. 4, but with triangular notches at the sides thereof.
Figure 15:
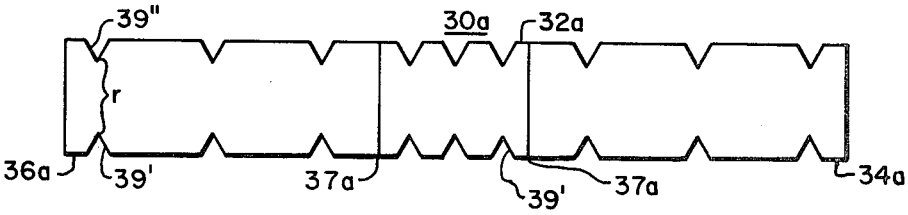
FIG. 15 shows a top view of the fuse element of FIG. 14.

Referring now to FIGS. 14, 15 and 16, still another embodiment of the invention is shown. In this embodiment of the invention, a fuse element 30*a* is shown. Fuse element 30*a* is essentially the same as fuse element 10*a* shown in FIGS. 4, 5 and 6, except that rather than having centrally located circular holes or openings 18, such as best shown in FIG. 2, there are triangularly shaped notched region 39' and 39" along either side of the fuse element 30*a*. Once again, as was the case with respect to fuse element 30, a complementary pair of notches 39' and 39" may form a region of reduced cross section of width r which is relatively the same width as the region r shown in FIG. 12. In that regard, and with respect to the embodiments of FIGS. 1 through 8, the width r between the apexes of the triangular notches 39' and 39" may be exactly the same size as the sum of the regions r/2 between diametrically opposed portions of a hole 18 of fuse element 10 and the sides of that fuse element. Of course it is to be understood that the previously described relationship need not necessarily be limiting—that is, the widths of the regions r/2 shown in FIG. 2 when added together need not be equal in width to the region r shown in FIGS. 11 through 16.

Figure 19:
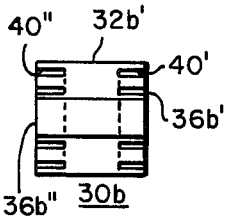
FIG. 19 shows an end view of the fuse element of FIG. 17.
Figure 17:
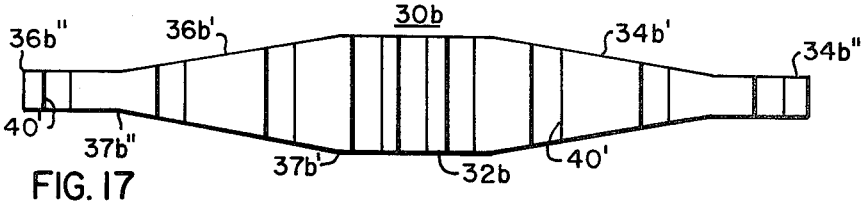
FIG. 17 shows a fuse element similar to that of FIG. 7, but with rectangular notches in the sides thereof.
Figure 18:
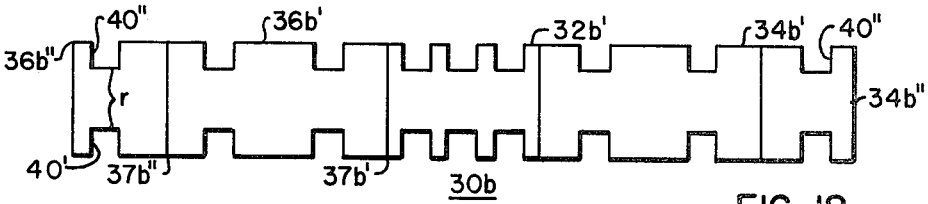
FIG. 18 shows a top view of the fuse element of FIG. 17.

Referring now to FIGS. 17 through 19, still another embodiment of the invention is shown. In this case, a fuse element 30*b* is depicted. Fuse element 30*b* is generally the same shape as fuse element 10*b* shown in FIGS. 7 through 9, except that the central longitudinally spaced holes 18*b* of embodiment 10*b* of FIGS. 7 through 9 have been replaced by rectangularly shaped side notches 40' and 40" in the fuse element 30*b*. Once again, the distance between the inner portions of complementary notches 40' and 40" may be equal to the distance r described previously with respect to other embodiments of the invention.

Figure 20:
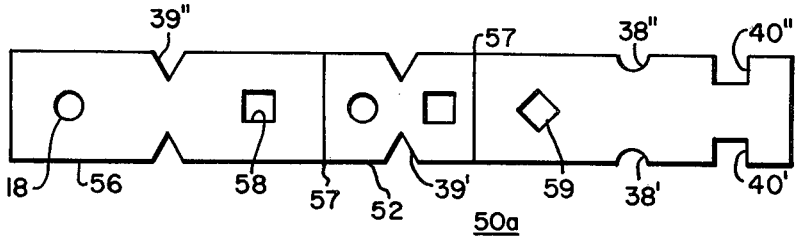
FIG. 20 shows a top view of a tapered fuse element having central openings and having side notches.

Referring now to FIG. 20, still another embodiment of the invention is shown. FIG. 20 depicts fuse element 50*a*. Characteristically, fuse element 50*a* is represented by a generally flat portion of portion of constant equally shaped cross sectional area 52 and tapered sections 54 and 56 on either side thereof. The portion 52 may be relatively small and similar to the portions 12 and 32 of embodiments 10 and 30, respectively, in which case, the tapered portions 54 and 56 will be smallest at the interfacing line 57 and largest at either end of the fuse element 50*a*. On the other hand, the central portion 52 may be relatively large and similar to embodiment 10*a* of FIGS. 4, 5 and 6 and/or embodiment 30*a* of FIGS. 14, 15, and 16. In the latter case, the tapered portions 54 and 56 are largest at the interfacing line 57 and become progressively smaller towards the end of the fuse element 50*a*. Fuse element 50*a* differs from the previously described fuse elements in that it shows a combination of centrally disposed openings, such as the circular holes 18, the relatively square or rectangularly shaped hole 58, and the diamond shaped hole 59. Furthermore, there are disposed on the outer sides of the fuse element 50*a* triangular notches, such as 39' and 39", semicircular notches such as 38' and 38" and rectangular or square shaped notches, such as 40' and 40".

Figure 21:
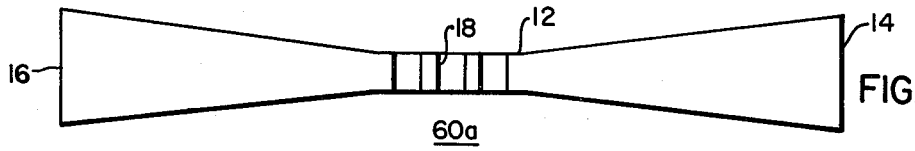
FIG. 21 shows a fuse element similar to that shown in FIG. 1, but which only has openings or notches in the thin central region thereof.
Figure 22:
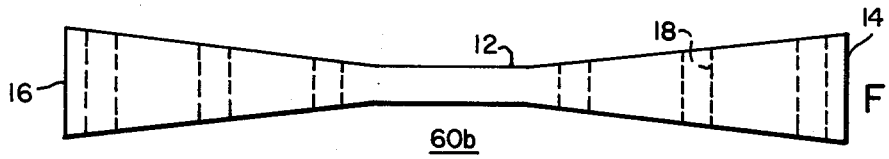
FIG. 22 shows a fuse element similar to that of FIG. 21, but which only has openings or side notches in the tapered portions thereof.
Figure 23:
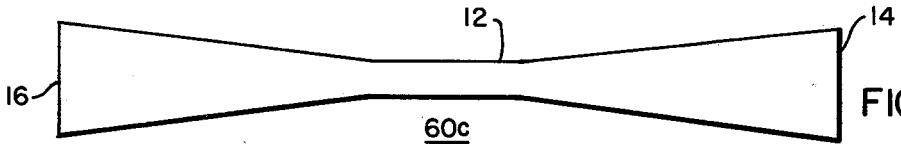
FIG. 23 shows a fuse element similar to FIGS. 1, 21 and 22 having no central openings or notches.

Referring now to FIGS. 21, 22 and 23, three other embodiments of the invention 60*a*, 60*b* and 60*c* respectively are shown. Essentially, the general shape of the fuse elements 60*a*, 60*b* and 60*c* is the same as the general shape of the fuse element 30 shown in FIGS. 11, 12 and 13 and the fuse element 10 shown in FIGS. 1, 2 and 3. The fuse element 60*a* differs from the fuse element 10 in that the central holes 18 are disposed only in the relatively flat region 12 and no holes are disposed in the tapered regions 14 and 16. Fuse elements 60*b* differs from fuse elements 30 and 10 in that the central holes 18 are disposed only in the tapered regions 14 and 16 and not in the relatively flat thin region 12. Finally, the fuse element 60*c* differs from either of the previously described fuse element 60*a*, 60*b*, 30 or 10 in that no central holes or openings are disposed in the fuse element.

It is to be understood with respect of the various embodiments of this invention that only a limited number of combinations of fuse shapes and notch or hole dispositions are shown. It is to be understood that the fuse element 10 may comprise central notches and/or central rectangular or square regions in addition to or instead of the central circular holes 18. It is also to be understood that the central holes or openings of whatever type shown and described need not be equidistant from both sides of the fuse element. It is also to be understood that the various notch arrangements shown are not limiting. It is also to be understood that the various central opening arrangements shown are not limiting.

Figure 24:
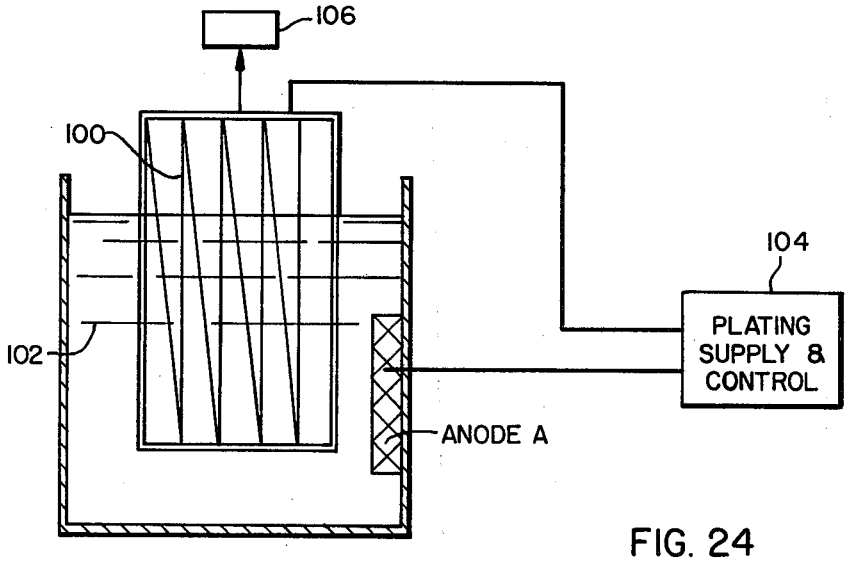
FIG. 24 shows apparatus which employs a process for making tapered fuse elements.

Referring now to FIG. 24, an apparatus for providing a taper to a given fuse element is shown. In this embodiment a group of relatively thin, preferably prenotched or centrally machined or drilled fuse elements 100 are suspended vertically in a plating bath 102. Electrical current is supplied between the fuse element 100 and the anode A of the plating bath 102 by a plating supply and control apparatus 104. The fuse elements are then withdrawn from the bath by withdrawal apparatus 106 at a generally constant rate while the plating current is continuously decreased at a relatively constant rate to provide successively larger portions of fuse material on those parts of the elements 100 which remain in the bath 102 after each instant of time during the withdrawal cycle.

The apparatus embodying the teachings and processes of this invention has many advantages. One advantage is associated with the fuse elements 10, 30, 60*a*, 60*b* and 60*c* for example and fuse elements which are similar thereto. The relatively small depth of the central region provides a portion of fuse element which will burn away or blow first during a low current fusing operation. At high current fusing operations, the central region openings or notches such as 18 of element 10 and 38' and 38'' of element 30 will generally melt simultaneously generating an arc voltage pulse. As the arclets burn towards each other, the notches along the thicker portions of the element begin to melt and add their voltage contribution to the composite arc voltage The overall effect of such a sequential action is to generate a sustained arc voltage having well defined characteristics. A fast rise in voltage generated by the quick melting of the uniform sections combined with the sequential additions from the melting of the tapered portions yields an arc voltage characteristic which is nearly rectangular when measured with respect to time, and therefore quite advantageous for sustaining an arc for current limiting purposes. On the other hand, on the low current fusing condition, it is desirable to have the element melt open in several places at the same time. This establishes several arcs in series. The multiple arcs are more effective in interrupting than are single arcs. Multiple openings are difficult to achieve in lower voltage fuse elements and multiple openings are enhanced by the elements of the embodiments 10*a*, 10*b*, 30*a* and 30*b*, for example and fuse elements which are similar thereto. It is known that the hottest section of the fuse will generally melt before the other sections will. This section tends to be near the center of the fuse because that is the region which generally has the poorest heat dissipation capability. If a generally flat top temperature vs fuse length characteristic could be achieved in the fuse element, the opportunity for several simultaneous fuse meltings would be greatly enhanced; and as was described previously, this is advantageous a for low current, high voltage fusing. Such a flat top distribution can be approximated by utilizing the tapered strap element where the region in the center is relatively thicker than the regions at the ends.

What I claim as my invention is:

1. A current limiting fuse, comprising:

(a) fuse housing means;

(b) fuse terminal means disposed at either end of said housing means; and (c) fuse element means, interconnected with said terminal means for interrupting electric current, said fuse element means having outer surfaces which are substantially flat, the length of said fuse element means being significantly larger than the width thereof, the depth of said fuse element means being tapered along a significant portion of the length thereof, said width of said fuse element means being significantly larger at its smallest point than said depth is at its largest point.

2. The combination as claimed in claim 1 wherein said fuse element means has an opening therein which is continuous through said depth.

3. The combination as claimed in claim 1 wherein said depth is largest at the middle of said fuse element means as measured along said length.

4. The combination as claimed in claim 1 wherein said depth is largest at an end of said fuse element means as measured along said length.

5. A fuse, comprising:

(a) fuse housing means;

(b) fuse terminal means disposed at either end of said housing means; and (c) fuse element means interconnected with said terminal means for interrupting electric current, said fuse element means having outer surfaces which are substantially flat, the length of said fuse element means being significantly larger than the width thereof, the depth of said fuse element means being tapered along a significant portion of the length thereof, said width of said fuse element means being significantly larger at its smallest point than said depth is at its largest point.

6. The combination as claimed in claim 5 wherein said fuse element means has an opening therein which is continuous through said depth.

7. The combination as claimed in claim 5 wherein said depth is largest at the middle of said fuse element means as measure along said length.

8. The combination as claimed in claim 5 wherein said depth is largest at an end of said fuse element means as measured along said length.

9. A fuse element, comprising:

outer surfaces which are substantially flat, the length of said fuse element being significantly larger than the width thereof, the depth of said fuse element being tapered along a significant portion of the length thereof, said width of said fuse element being significantly larger at its smallest point than said depth is at its largest point.

10. The fuse element as claimed in claim 9 wherein said fuse element has an opening therein which is continuous through said depth.

11. The fuse element as claimed in claim 9 wherein said depth is largest at the middle of said fuse element as measured along said length.

12. The fuse element as claimed in claim 9 wherein said depth is largest at an end of said fuse element as measured along said length.

13. A current limiting fuse, comprising:

(a) fuse housing means;

(b) fuse terminal means disposed at either end of said housing means; and (c) fuse element means interconnected with said terminal means for interrupting electric current, said fuse element means having outer surfaces which are substantially flat, the length of said fuse element means being significantly larger than the width thereof, the depth of said fuse element means being tapered along a significant portion of the length thereof, said width of said fuse element means being substantially uniform and being significantly larger than said depth is at its largest point.

14. A fuse, comprising:

(a) fuse housing means;

(b) fuse terminal means disposed at either end of said housing means; and (c) fuse element means interconnected with said terminal means for interrupting electric current, said fuse element means having outer surfaces which are substantially flat, the length of said fuse element means being significantly larger than the width thereof, the depth of said fuse element means being tapered along a significant portion of the length thereof, said width of said fuse element means being substantially uniform and being significantly larger than said depth is at its largest point.

* * * * *